US005452903A

United States Patent [19]

Larrabee

[11] Patent Number: 5,452,903

[45] Date of Patent: Sep. 26, 1995

[54] AUDIBLE FLYING DISC TARGET ASSEMBLY

[76] Inventor: Edwin D. Larrabee, 1804 Palo Duro, Austin, Tex. 78757

[21] Appl. No.: 255,664

[22] Filed: Jun. 9, 1994

[51] Int. Cl.[6] ..... A63B 63/02

[52] U.S. Cl. ..... 273/400; 273/381

[58] Field of Search ..... 273/400, 401, 273/381, 382, 1.5 R, 1.5 A

[56] References Cited

U.S. PATENT DOCUMENTS

| | | | |
|---|---|---|---|
| 922,717 | 5/1909 | Parker | 273/401 |
| 4,809,988 | 3/1989 | Hunter | 273/400 |

*Primary Examiner*—William H. Grieb
*Attorney, Agent, or Firm*—Matthew J. Booth

[57] ABSTRACT

This invention discloses an audible target assembly for use in a flying disc golf game. The target assembly consists of an upright post and a tube mounted on the post that when combined produce sound upon impact of the tube by a flying disc. A first plurality of radial support rods around the outer periphery of the tube attaches a plurality of individually suspended members to the tube. The members extend downwardly and connect to a second plurality of radial support rods mounted on the upright post located beneath the tube. The plurality of individually suspended members form a relatively dense mass in the path of a flying disc that transfer the kinetic energy of the disc to the members that in turn come in contact with the tube to produce an audible sound.

19 Claims, 7 Drawing Sheets

AUDIBLE FLYING DISC TARGET ASSEMBLY

BACKGROUND OF THE INVENTION

1. Field of the Invention

The present invention relates to flying disc target assemblies. More particularly, the present invention relates to flying disc target assemblies that provide an audible sound upon registering the impact of the disc on the target.

2. Description of the Related Art

Flying disc golf has become extremely popular and is enjoying widespread appeal. Such games occur on courses located in parks or other recreational areas. The course consists of a number of "holes" with each "hole" having a "tee" from where each player throws a flying disc at a post or target positioned at a selected distance from the "tee." Similar to ball golf, the objective of the flying disc golf game is to hit the target with a disc in the shortest number of throws of the disc. The player with the lowest score over the course is the winner.

A typical course usually contains visual obstacles such as trees and hills between the tee and the target to make the game more challenging to the players. An unfortunate byproduct of the visual obstacles is that they make visual observation of a hit with the target quite difficult. One type of method to insure the registration of a hit is to use an entrapment device for the target. The prior art in the game of flying disc golf contains numerous references to entrapment devices, see for example U.S. Pat. No. 4,039,189, U.S. Pat. No. 4, 461,484, U.S. Pat. No. 4,792,143 and U.S. Pat. No. 5,048,845. An entrapment device works as its name suggests, that is the device prevents or entraps the disc from flying or deflecting away after hitting the target. The primary means for scoring a hole using an entrapment target is having the disc come to rest in the basket The actual hitting of the target is of secondary importance.

A byproduct of the entrapment design is that the sound produced by a disc hitting an entrapment device does not travel very far and is not reliable as an indicator for hitting the target at longer distances. Another and more subtle of a problem with entrapment devices is that the basket usually becomes the primary focus of the player, instead of the target top with the chains. Here the result is that the disc more often than not comes up short on distance because the player was effectively aiming too low at the target. Entrapment devices generally work as advertised, but they do not always entrap the disc. Failures to entrap the disc, especially when there is no visual observation of the target, can often lead to great commotion and discussion between the players in determining whether the disc has hit the target. When the target is not under visual observation, hearing the disc hit the target becomes the primary means for scoring the hole. The present invention, however, uses the audible sound of the disc hitting the target as the primary means of scoring the hole, making this invention superior to entrapment devices especially on holes with visual obstructions or long fairways.

There are several trends in the game that greatly increase the failure rate of entrapment target assemblies. One trend is the relatively modern small heavy discs (e.g., 21 cm in diameter, and 150 grams or more in weight) that are now the standard for most amateur and professional players. Additionally, new throwing techniques such that the disc hits the target almost perpendicular to the ground result in the occasional failure of a disc becoming entrapped. As a result there is a need for a more reliable target. Furthermore, the entrapment assemblies disclosed in U.S. Pat. No. 4,039,189, U.S. Pat. No. 4,461,484, and U.S. Pat. No. 4,792,143 are apparently for a fixed and stationary use such that portability of the entrapment assembly from one location to another is inconvenient. The entrapment assembly in U.S. Pat. No. 5,048,845, though designed for portable use, is actually both awkward and cumbersome to setup and move around.

OBJECT AND SUMMARY OF THE INVENTION

An object of the present invention is to provide a target assembly for flying disc golf that registers a hit using an audible sound upon impact of the assembly by a disc.

A feature of the invention is that the target assembly produces a very audible sound such that the sound carries for distance sufficient for the target to register a hit on long throws or blind throws.

Another feature of the present invention is that the target assembly registers a hit for discs impacting the assembly when the discs hit the assembly at conventional and unconventional angles.

An advantage of the present invention is that the target assembly is highly portable.

Another advantage of the present is that the assembly is inexpensive to manufacture and inexpensive for the end consumers.

The present invention provides an audible indication to the thrower for registering the impact of the disc upon the target. When visual obstacles such as trees block visual observation of the target, audible indication of the impact provides the only incontestable means for registering the impact. Additionally, the present invention ensures a positive indication of a hit even for the ever changing throwing techniques and flying disc changes that can cause entrapment devices to fail. Since the present invention does not entrap discs, the resulting overall design of the present invention provides for a very portable device that is easy to setup and move around.

The present invention is an audible target assembly for a flying disc golf game. The invention comprises an upright post attached to the inside of a tube. Attached to the outside of the tube is a plurality of individually suspended members. A first plurality of radial support rods at spaced annular positions around the outside periphery of the tube connects one end of the individually suspended members to the tube. A second plurality of radial support rods at spaced annular positions around the outside periphery of the upright post connects the other end of the individually suspended members to the upright post. An embodiment of the present invention designed for portable use further comprises a handle attached the upright post and a base for mounting the upright post.

DESCRIPTION OF THE DRAWINGS

To further aid in understanding the invention, the attached drawings help illustrate specific features of the invention. The following is a brief description of the attached drawings.

DETAILED DESCRIPTION OF THE INVENTION

Consideration of the following example, which is purely exemplary, further clarifies the use of the invention.

Figure 1:
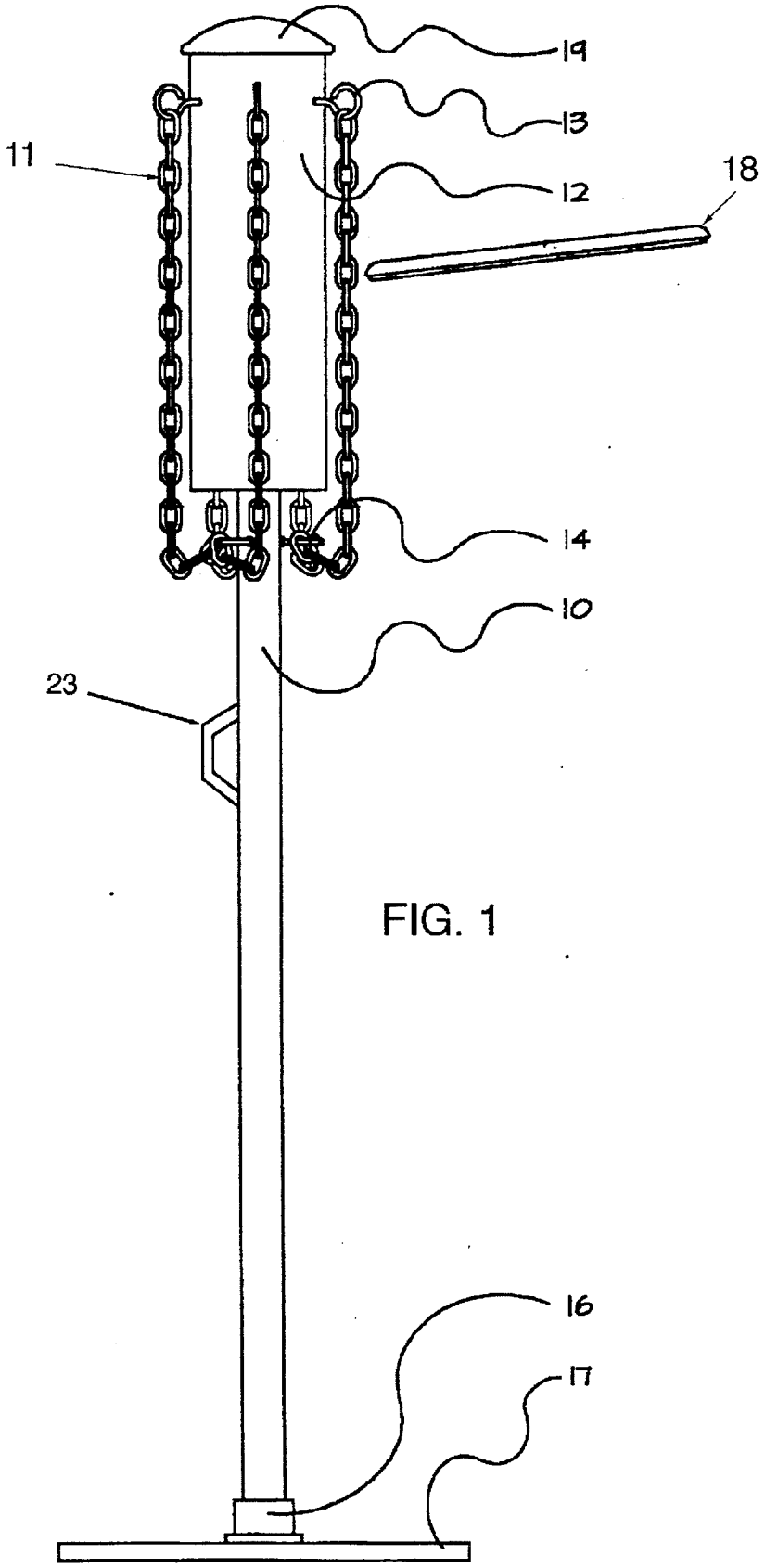
FIGS. 1 and 1A are elevational views of a flying disc audible target assembly showing different embodiments of the invention.
Figure 1A:
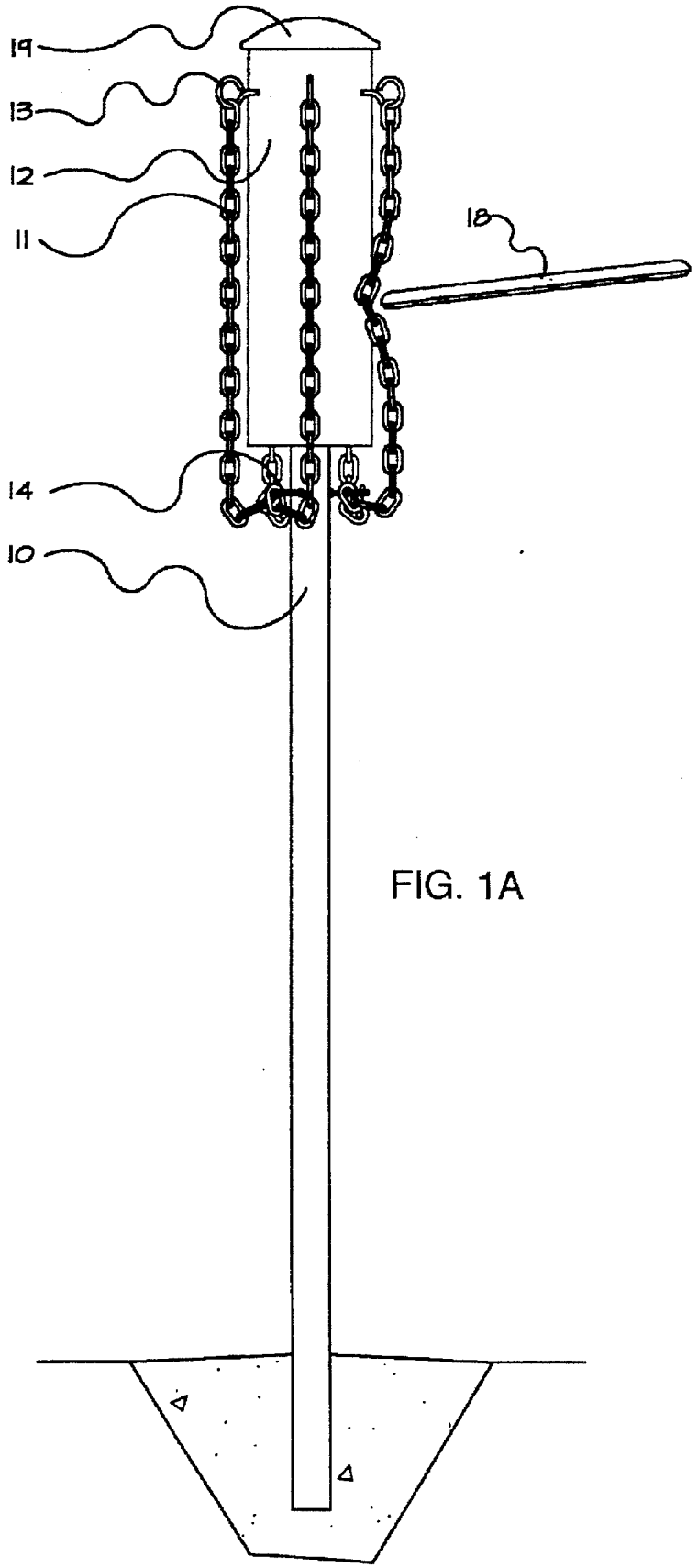

FIG. 1 discloses the preferred embodiment designed for portable use. FIG. 1A discloses the preferred embodiment designed for stationary or permanent mounting. With the exception of the base mounting and handle, both FIGS. 1 and 1A are identical. Turning now to FIG. 1, an upright central post 10 mounts into base 17 by flange 16. Base 17 needs to be of sufficient weight and size to prevent the target assembly from falling over upon impact of the target by a disc. Handle 23 attaches to upright post 10 and allows the entire target assembly of FIG. 1 to be extremely portable. In FIG. 1A, upright post 10 mounts into the ground or preferably into cement or concrete.

Back to FIG. 1, tube 12 attaches to top of the upright post 10. Tube 12 is a hollow and cylindrical device that is at least 8 to 16 inches long and preferably 12.5 inches long. The inner diameter of tube 12 is greater than the outer diameter of upright post 10 and is among 2 to 6 inches in diameter and is preferably 4 inches in diameter.

Figure 3A:
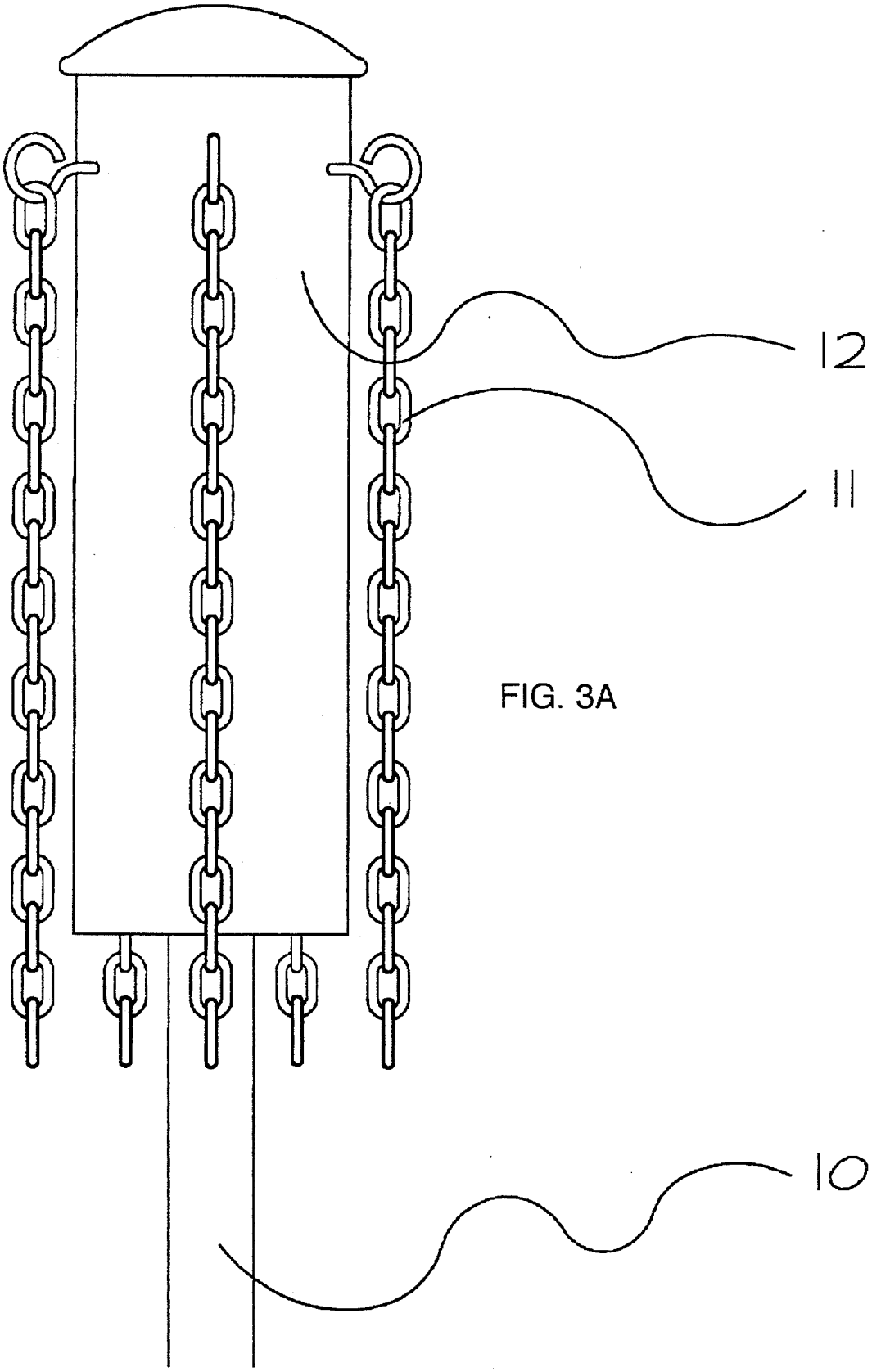
FIGS. 3A, 3B, and 3C show different embodiments of the invention of FIG. 2.
Figure 3B:
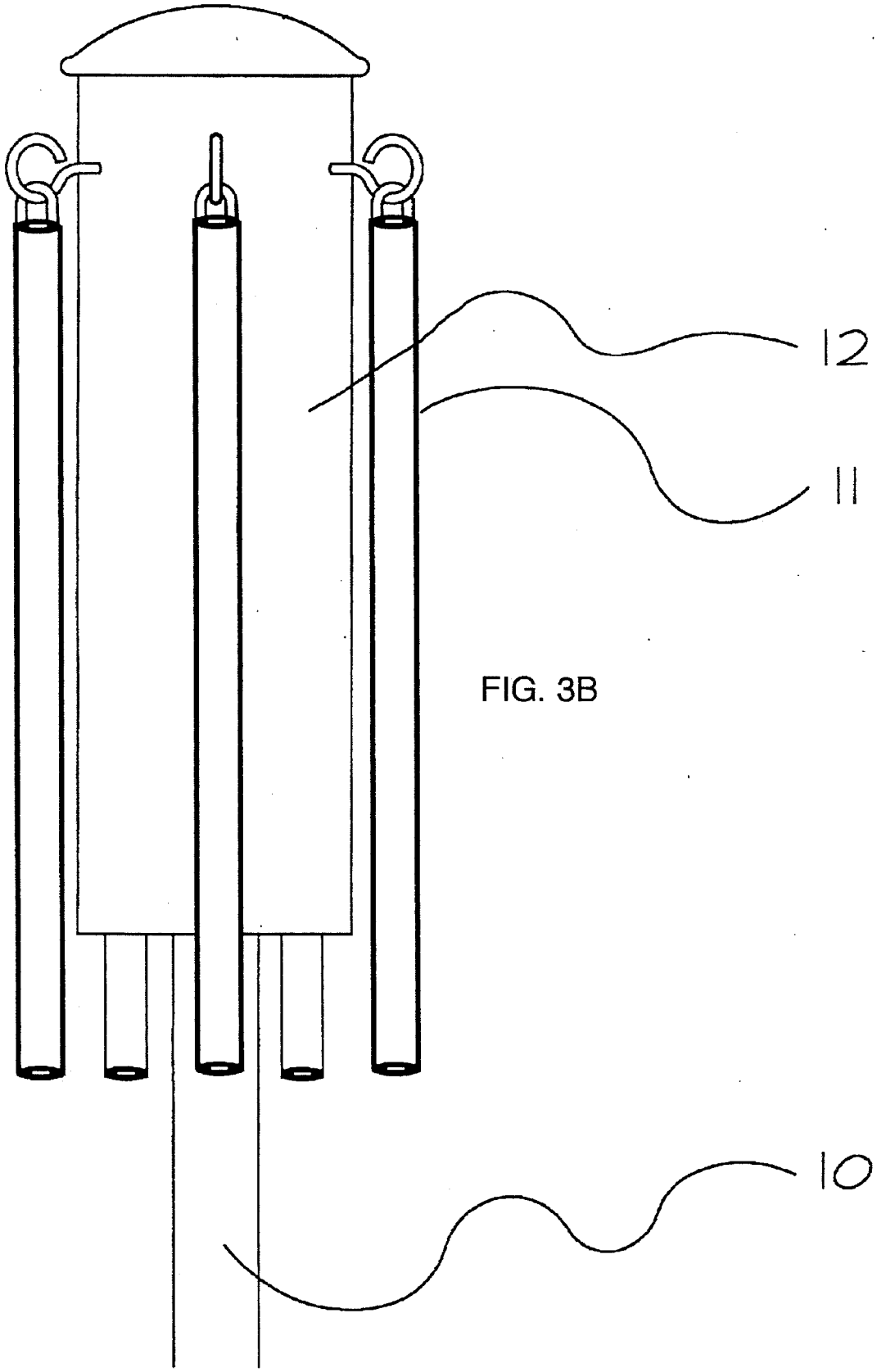
Figure 3C:
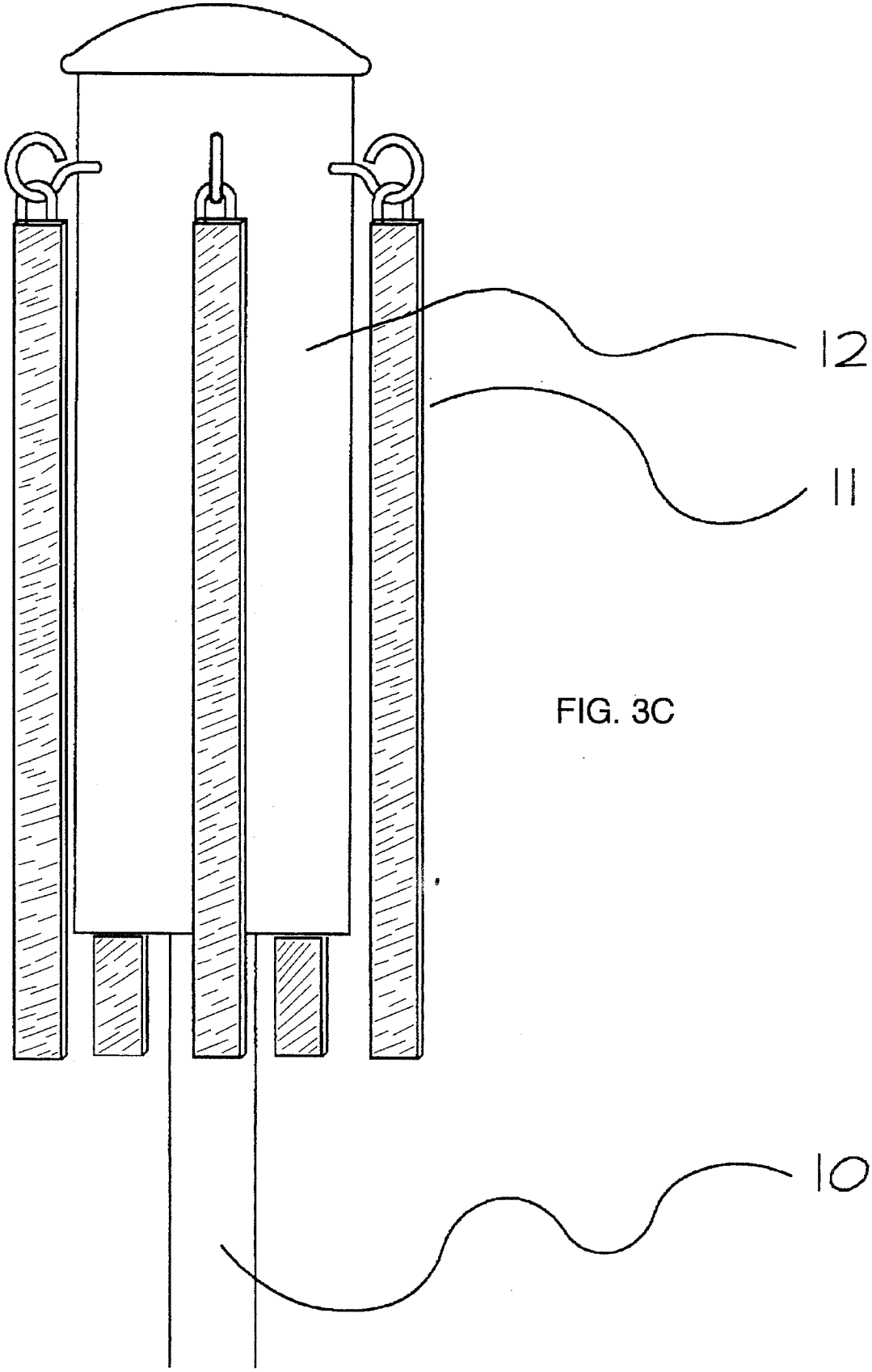

At the top and around the outer periphery of tube 12 is a first plurality of support rods 13 of at least 3 and preferably 6 in number. The support rods 13 are at spaced annular positions around the outer periphery of tube 12. Attached to the plurality of radial support rods 13 are a plurality of individually suspended members 11. The preferred embodiment of the invention uses chains for the plurality of individually suspended members 11. Alternative embodiments of the chain also include elongated strips or tubes with the option of the members swinging freely instead of attached at both ends. FIG. 3A shows an alternate embodiment of the invention with the chains swinging freely. FIGS. 3B and 3C show alternate embodiments of the invention using tubes and elongated strips respectively instead of chains. The plurality of individually suspended members attach at the other end to a second plurality of radial support rods 14 of at least 2 and preferably 3 in number. The second plurality of radial support rods 14 are at spaced annular positions around the outer periphery of upright post 10. Lastly, top cap 19 attaches to one end of tube 12.

A flying disc 18 impacting the plurality of individually suspended members 11 will cause the members to travel toward and come into contact with tube 12 thus producing an audible tone or sound. The members 11 form a relatively dense mass in the path of a flying disc 18 that transfer the kinetic energy of the disc to the members that in turn come in contact with tube 12 to produce the audible sound. The resulting sound incontestably proves that the disc has hit the target assembly on the hole. This design allows the present invention to generate a highly audible sound, that carries for a long distance, when a disc impacts the target. An analogy of the invention's design is that the invention is like a bell with the tube being the bell and the plurality of individually suspend members, chains for example, being the bell's clappers.

Figure 2:
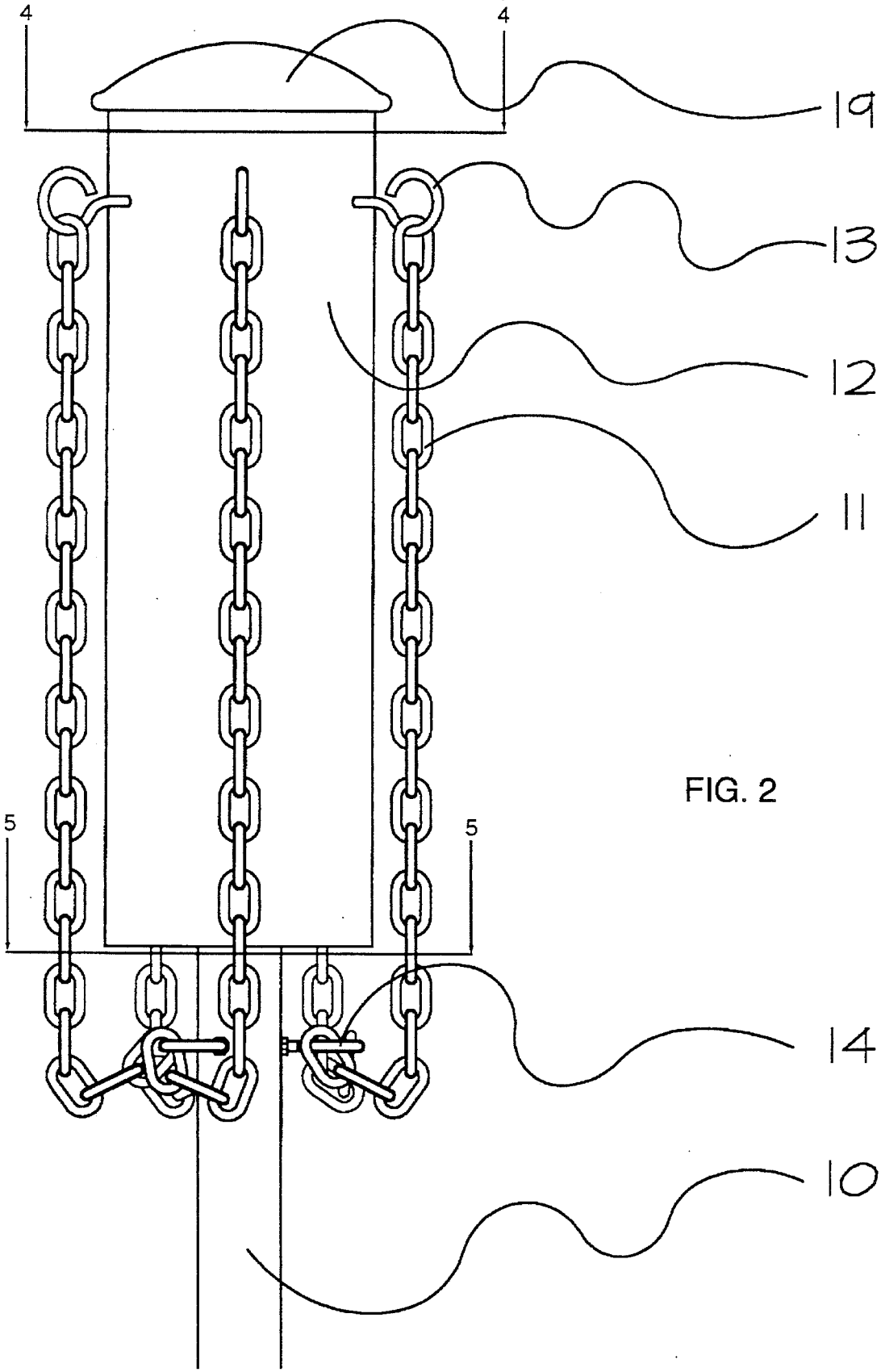
FIG. 2 is an enlarged top plan view of the assembly of FIG. 1.

FIG. 2 is an enlarged top plan view of the target assembly of FIG. 1.

Figure 4:
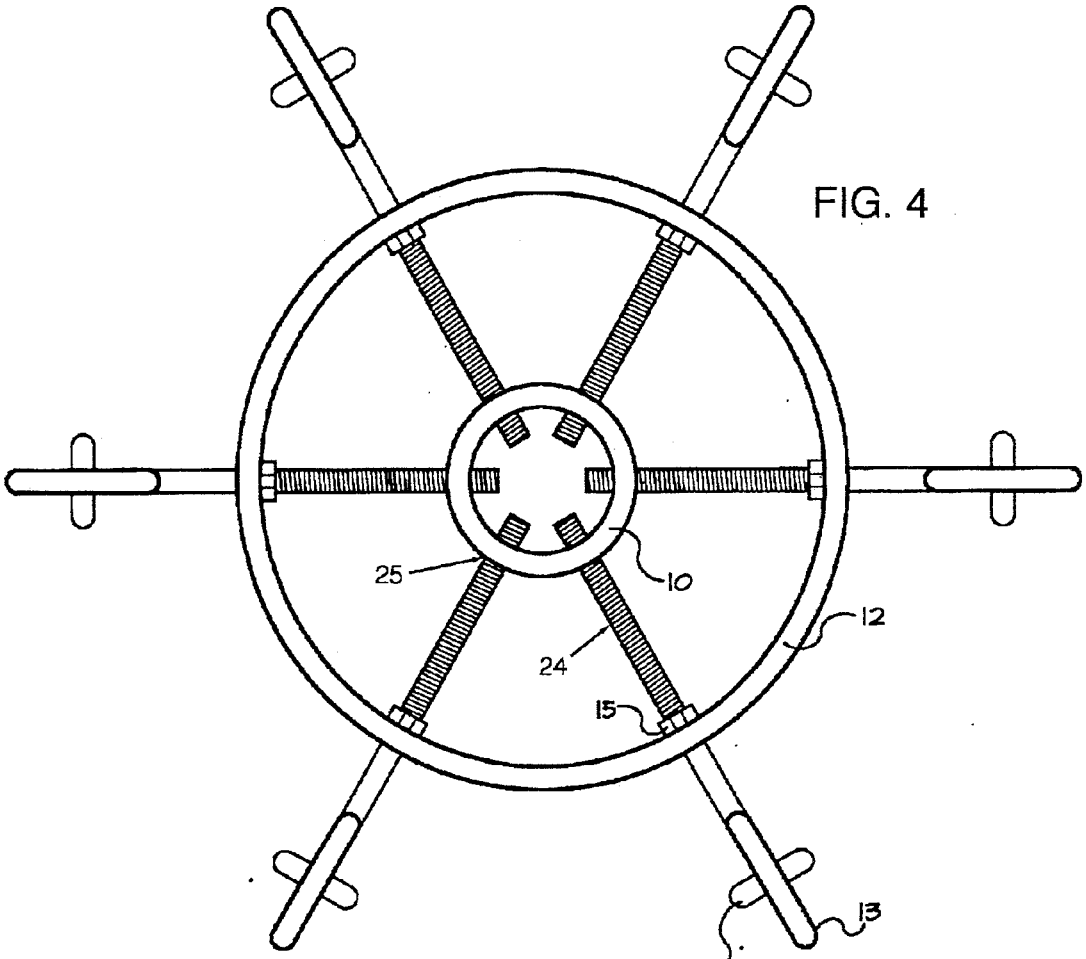
FIG. 4 is an overhead plan view of the assembly of FIG. 2 taken through line 4—4.

FIG. 4 is an overhead plan view of the target assembly of FIG. 2 taken through line 4—4. The first plurality of radial support rods 13 with loops at one end connect tube 12 to the upright pole 10. The preferred embodiment of the invention uses a combination of threaded bolts 24, nuts 15, and tapped threaded holes 25 in the appropriate places to connect tube 12 with upright post 10. Other embodiments of the invention comprehend using welded or brazed rods or even plastic rods for support and connection. An alternate embodiment of the invention comprehends eliminating the connection of rods 13 between tube 12 and upright post 10 and instead using top cap 19 of FIG. 1 as the means for attaching and supporting tube 12 with upright post 10. The first plurality of radial support rods 13 contain loops at one end that is suitable for connecting the plurality of individually suspended members 11 to rods 13.

Figure 5:
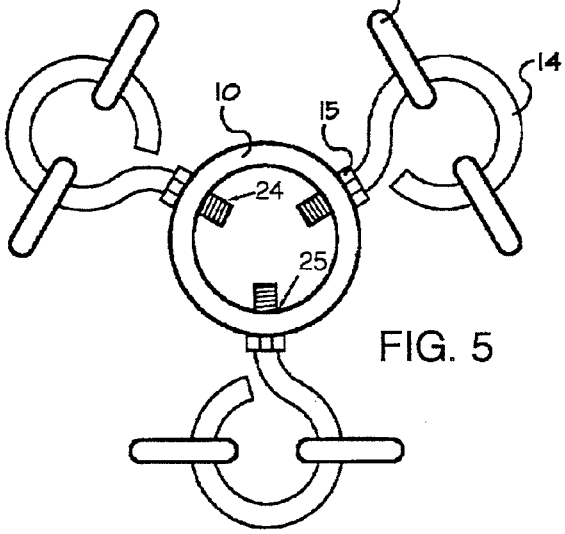
FIG. 5 is a cross-sectional overhead view of FIG. 2 taken through line 5—5.

FIG. 5 is a cross sectional overhead view of FIG. 2 taken through line 5—5. A second plurality of radial support rods 14 with loops at one end attach to upright post 10. The preferred embodiment of the invention uses a combination of threaded bolts 24, nuts 15, and tapped threaded holes 25 in the appropriate places to connect support rods 14 with upright post 10. The plurality of individually suspended members 11 connect to the ends of rods 14. Other embodiments of the invention comprehend welding, brazing or other suitable means for attaching rods 14 to upright post 10. Another embodiment of the invention uses a ring for connecting the plurality of individually suspended members to the upright post. In this embodiment, the ring replaces the loops at the end of the support rods and goes completely around the outer periphery of the upright post so as to effectively gather the plurality of individually suspended members at one point on the upright post. The ring may connect to the upright post using radial support rods as in other embodiments, or the ring may not connect to the upright post and instead hang freely and gather the plurality of individually suspended members in one place.

Other embodiments of the invention will be apparent to those skilled in the art after considering this specification or practicing the disclosed invention. The specification and examples above are exemplary only, with the true scope of the invention being indicated by the following claims.

I claim the following invention:

1. An audible target assembly for use in a flying disc game, comprising:

an upright post;

a hollow tube capable of generating noise when impacted by an object, said upright post being inside of said tube, one end of said tube fastened to said upright post;

a first plurality of radial support rods attached to said tube, said first plurality of radial support rods at spaced annular positions around the periphery of said tube; and a plurality of individually suspended members, each member of said plurality of individually suspended members attaches at the upper end to an individual support rod of said first plurality of radial support rods.

2. The assembly of claim 1 wherein each member of said plurality of individually suspended members connects at the lower end to said upright post.

3. The assembly of claim 1 further comprising a second plurality of radial support rods, said second plurality of radial support rods attached to said upright post and at spaced annular positions around the periphery of said upright post, each member of said plurality of individually suspended members attaches at the upper end to an individual support rod of said first plurality of radial support rods and at the lower end to an individual support rod of said second plurality of radial support rods.

4. The assembly of claim 1 further comprising:

a handle attached to said upright post; and a base, said upright post mounts into said base.

5. The assembly of claim 1 wherein said plurality of individually suspended members are chains.

6. The assembly of claim 1 wherein said plurality of individually suspended members are tubes.

7. The assembly of claim 6 wherein said plurality of individually suspended members are elongated strips.

8. An audible target assembly for use in a flying disc game, comprising:

an upright post;

a tube attached to said upright post, said upright post being inside of said tube;

a first plurality of radial support rods attached to said tube, said first plurality of radial support rods at spaced annular positions around the periphery of said tube;

a second plurality of radial support rods attached to said upright post, said second plurality of radial support rods at spaced annular positions around the periphery of said upright post; and a plurality of individually suspended members, each member of said plurality of individually suspended members attaches at the upper end to an individual support rod of said first plurality of radial support rods and at the lower end to an individual support rod of said second plurality of radial support rods.

9. The assembly of claim 8 further comprising:

a handle attached to said upright post; and a base, said upright post mounts into said base.

10. The assembly of claim 8 further comprising a ring for securing the lower end of each said member of said plurality of individually suspended members.

11. An audible target assembly for use in a flying disc game, comprising:

an upright post;

a hollow tube capable of generating noise when impacted by an object, said upright post being inside of said tube, one end of said tube fastened to said upright post;

a plurality of individually suspended members;

first attaching means for attaching the upper end of an individual member of said plurality of individually suspended members to said tube; and second attaching means for attaching the lower end of each said member of said plurality of individually suspended members to said upright post.

12. The assembly of claim 11 wherein first attaching means further comprises a first plurality of radial support rods attaching the upper end of each said member of said plurality of individually suspended members to said tube, said first plurality of radial support rods at spaced annular positions around the periphery of said tube.

13. The assembly of claim 11 wherein said second attaching means further comprises a second plurality of radial support rods attaching the lower end of each said member of said plurality of individually suspended members to said upright post, said second plurality of radial support rods at spaced annular positions around the periphery of said upright post.

14. The assembly of claim 11 further comprising:

a handle attached to said, upright post; and a base, said upright post mounts into said base.

15. An audible target assembly for use in a flying disc game, comprising:

an upright post;

a hollow tube capable of generating noise when impacted by an object, said upright post being inside of said tube, one end of said tube fastened to said upright post;

a plurality of individually suspended members; and first attaching means for attaching the upper end of an individual member of said plurality of individually suspended members to said tube.

16. The assembly of claim 15 wherein first attaching means further comprises a first plurality of radial support rods attaching the upper end of each said member of said plurality of individually suspended members to said tube, said first plurality of radial support rods at spaced annular positions around the periphery of said tube.

17. The assembly of claim 15 further comprising second attaching means for attaching the lower end of each said member of said plurality of individually suspended members to said upright post.

18. The assembly of claim 17 wherein said second attaching means further comprises a second plurality of radial support rods attaching the lower end of each said member of said plurality of individually suspended members to said upright post, said second plurality of radial support rods at spaced annular positions around the periphery of said upright post.

19. The assembly of claim 15 further comprising:

a handle attached to said upright post; and a base, said upright post mounts into said base.

* * * * *